US009416954B2

(12) United States Patent
Miller

(10) Patent No.: US 9,416,954 B2
(45) Date of Patent: Aug. 16, 2016

(54) LIGHT FIXTURE WITH THERMAL MANAGEMENT PROPERTIES

(71) Applicant: ABL IP HOLDING LLC, Conyers, GA (US)

(72) Inventor: Michael Ray Miller, Conyers, GA (US)

(73) Assignee: ABL IP Holding LLC, Decatur, GA (US)

( * ) Notice: Subject to any disclaimer, the term of this patent is extended or adjusted under 35 U.S.C. 154(b) by 381 days.

(21) Appl. No.: 13/834,319

(22) Filed: Mar. 15, 2013

(65) Prior Publication Data

US 2013/0294072 A1 Nov. 7, 2013

Related U.S. Application Data

(60) Provisional application No. 61/688,068, filed on May 7, 2012.

(51) Int. Cl.

| | |
|---|---|
| ***F21V 29/00*** | (2015.01) |
| ***F21V 7/00*** | (2006.01) |
| ***F21V 13/04*** | (2006.01) |
| ***F21S 8/04*** | (2006.01) |
| ***F21V 29/83*** | (2015.01) |
| *F21Y 101/02* | (2006.01) |

(52) U.S. Cl.

CPC ..... *F21V 29/2293* (2013.01); *F21S 8/04* (2013.01); *F21V 7/00* (2013.01); *F21V 13/04* (2013.01); *F21V 29/83* (2015.01); *F21Y 2101/02* (2013.01)

(58) Field of Classification Search

CPC ... F21Y 2101/02; F21Y 2103/00; F21K 9/00; F21S 4/003; F21V 29/004; F21V 7/005; F21V 17/00

USPC ..... 362/235, 218, 294, 217.05, 367, 373

See application file for complete search history.

(56) References Cited

U.S. PATENT DOCUMENTS

| | | | | |
|---|---|---|---|---|
| 6,411,510 | B2 * | 6/2002 | Sasa | 165/122 |
| D592,786 | S | 5/2009 | Bisberg et al. | |

(Continued)

OTHER PUBLICATIONS

I-Beam™ Fluorescent High Bay Lighting, "The High Ambient Solution," Lithonia Lighting, 2005 (7 pages)—Admitted Prior Art.

(Continued)

*Primary Examiner* — Alan Cariaso
*Assistant Examiner* — Mark Tsidulko
(74) *Attorney, Agent, or Firm* — Kilpatrick Townsend & Stockton, LLP

(57) ABSTRACT

A light fixture including an electronic housing and at least one optical chamber positioned on each side of the electronic housing. In some embodiments, the optical chambers are positioned a distance from the electronic housing so as to avoid creation of a thermal path between the optical chambers and the electronic housing. Each optical chamber includes a heat sink and a plurality of LEDs mounted on a PCB that is, in turn, mounted on the heat sink. A reflector is positioned over at least a portion of the PCB. In some embodiments, vents extend through the heat sink and a fin extends upwardly from the heat sink and angles at least partially over at least some of the vents. In use, air enters the optical chambers and exits the fixture through the top vents in the heat sink. The air circulates over the reflector, carrying heat from the reflectors during the process. Heat is also conducted to the air from the heat sink. The angled fins extending over the top vents provide additional surface area for contact with the air and thus facilitate additional heat transfer from the heat sink.

15 Claims, 19 Drawing Sheets

(56) References Cited

U.S. PATENT DOCUMENTS

| | | | | |
|---|---|---|---|---|
| 7,922,354 | B2 * | 4/2011 | Everhart | 362/235 |
| 7,950,836 | B2 * | 5/2011 | Veiga et al. | 362/519 |
| 7,993,031 | B2 * | 8/2011 | Grajcar | 362/294 |
| 8,167,466 | B2 * | 5/2012 | Liu | 362/373 |
| 8,235,540 | B2 * | 8/2012 | Park et al. | 362/97.1 |
| 8,529,085 | B2 * | 9/2013 | Josefowicz et al. | 362/158 |
| 8,562,174 | B2 * | 10/2013 | Pickholz | 362/235 |
| D703,858 | S | 4/2014 | Miller | |
| 8,727,565 | B2 * | 5/2014 | Domagala et al. | 362/235 |

OTHER PUBLICATIONS

C-Series™ LED High Bay, Albeo Technologies, Jul. 21, 2009 (4 pages)—Admitted Prior Art.

I-Beam® Fluorescent High Bay Lighting, Fluorescent High Bay, 4-, 6- or 8-lamp T5, Lithonia Lighting, Sep. 29, 2010 (2 pages)—Admitted Prior Art.

Lusio Essentials™ Bay Series, "Energy Efficient LED Fixtures for Comerical & Industrial Applications," Lusio Solid-State Lighting, 2011 (4 pages)—Admitted Prior Art.

I-Beam® IBZ, Flourescent High Bay IBZ 4-, 6- or 8-lamp T5HO, Dec. 19, 2012 (2 pages)—Admitted Prior Art.

I-Beam® IBZ, Flourescent High Bay IBZ 4-, 6- or 8-lamp T-8, Dec. 19, 2012 (3 pages)—Admitted Prior Art.

Essentials™ Bay Series v 2.0, 6 Short LED Modules (6MS) Fixture Overview, Lusio Commercial & Industrial, 2013 (4 pages)—Admitted Prior Art.

Essentials™ Bay Series v 2.0, 4 LED Modules (4M) Fixture Overview, Lusio Commercial & Industrial, 2013 (4 pages)—Admitted Prior Art.

Essentials™ Bay Series v 2.0, 6 LED Modules (6M) Fixture Overview, Lusio Commercial & Industrial, 2013 (4 pages)—Admitted Prior Art.

"Office Action," for Canadian Application No. CA 2,810,868, mailed Dec. 30, 2014, 2 pages.

Notice of Allowance for Canadian Application No. CA 2,810,868, mailed May 20, 2015, 1 page.

* cited by examiner

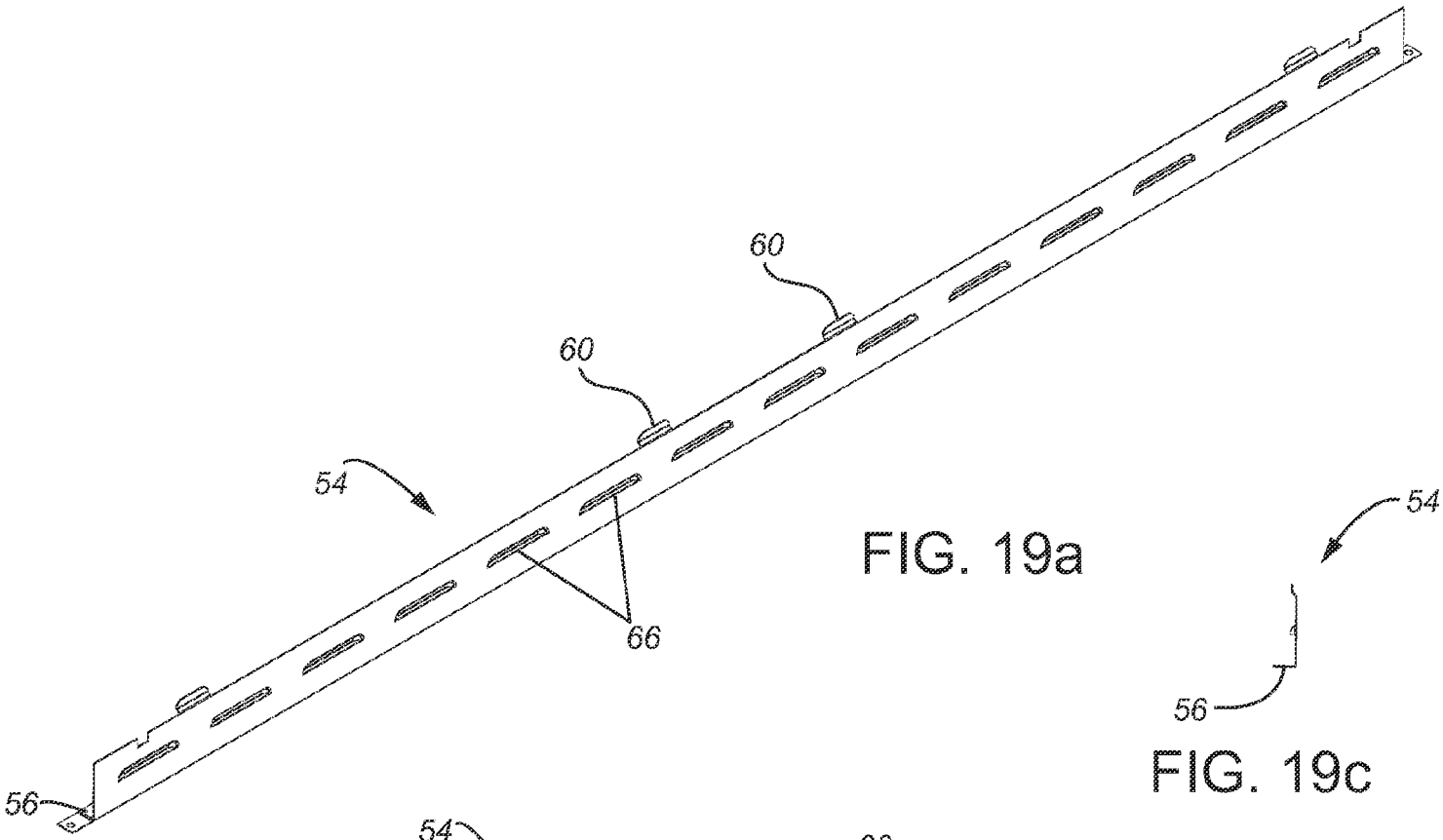
FIG. 19a
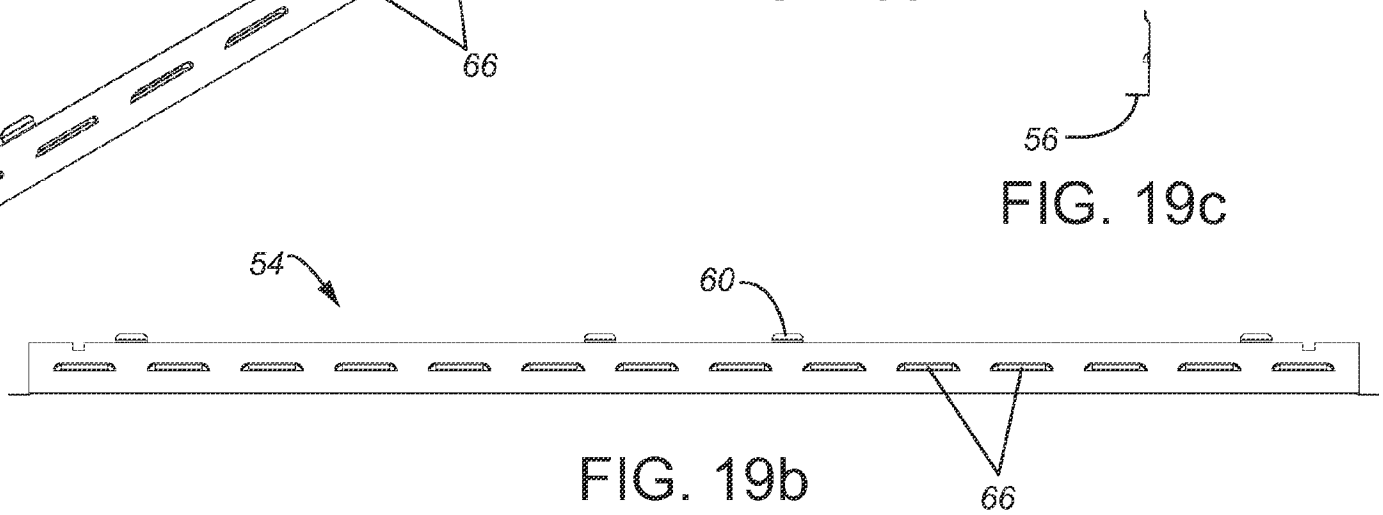
FIG. 19b
FIG. 19c

LIGHT FIXTURE WITH THERMAL MANAGEMENT PROPERTIES

CROSS-REFERENCE TO RELATED APPLICATIONS

This application claims the benefit of U.S. Provisional Application No. 61/688,068, filed May 7, 2012, the entirety of which is herein incorporated by reference.

FIELD

Embodiments of the present invention relate to a light fixture having thermal management properties.

BACKGROUND

Light emitting diodes ("LED") are typically mounted on a printed circuit board ("PCB") and wired to the PCB. LEDs generate a great deal of heat during operation, which, if not transferred from the LEDs, can detrimentally impact the efficiency of the LEDs. Heat generation in a closed fixture can be particularly problematic and removal of such heat from the fixture even more challenging.

SUMMARY

Certain embodiments of the present invention provide a light fixture having an electronic housing and at least one optical chamber positioned on each side of the electronic housing. In some embodiments, the optical chambers are positioned a distance from the electronic housing so as to avoid creation of a thermal path between the optical chambers and the electronic housing. Each optical chamber includes a heat sink and a plurality of LEDs mounted on a PCB that is, in turn, mounted on the heat sink. A reflector is positioned over at least a portion of the PCB. In some embodiments, vents extend through the heat sink and fins extend upwardly from the heat sink and angle at least partially over at least some of the vents.

In use, air enters the optical chambers and exits the fixture through the top vents in the heat sink. The air circulates over the reflectors, carrying heat from the reflectors during the process. Heat is also conducted to the air from the heat sink. The angled fins extending over the top vents provide additional surface area for contact with the air and thus facilitate additional heat transfer from the heat sink.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE FIGURES

Illustrative embodiments of the present invention are described in detail below with reference to the following drawing figures:

FIG. 19*a* is a top perspective view of one embodiment of a side door frame.

FIG. 19*b* is a side elevation view of the side door frame of FIG. 19*a*.

FIG. 19*c* is an end view of the side door frame of FIG. 19*a*.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The Figures illustrate various views of embodiments of light fixture 10 contemplated herein. The light fixture 10 is designed to be suspended from a ceiling (such as with brackets or pendant hanger 2) but it is also contemplated that the light fixture can be recessed within a ceiling.

Figure 1:
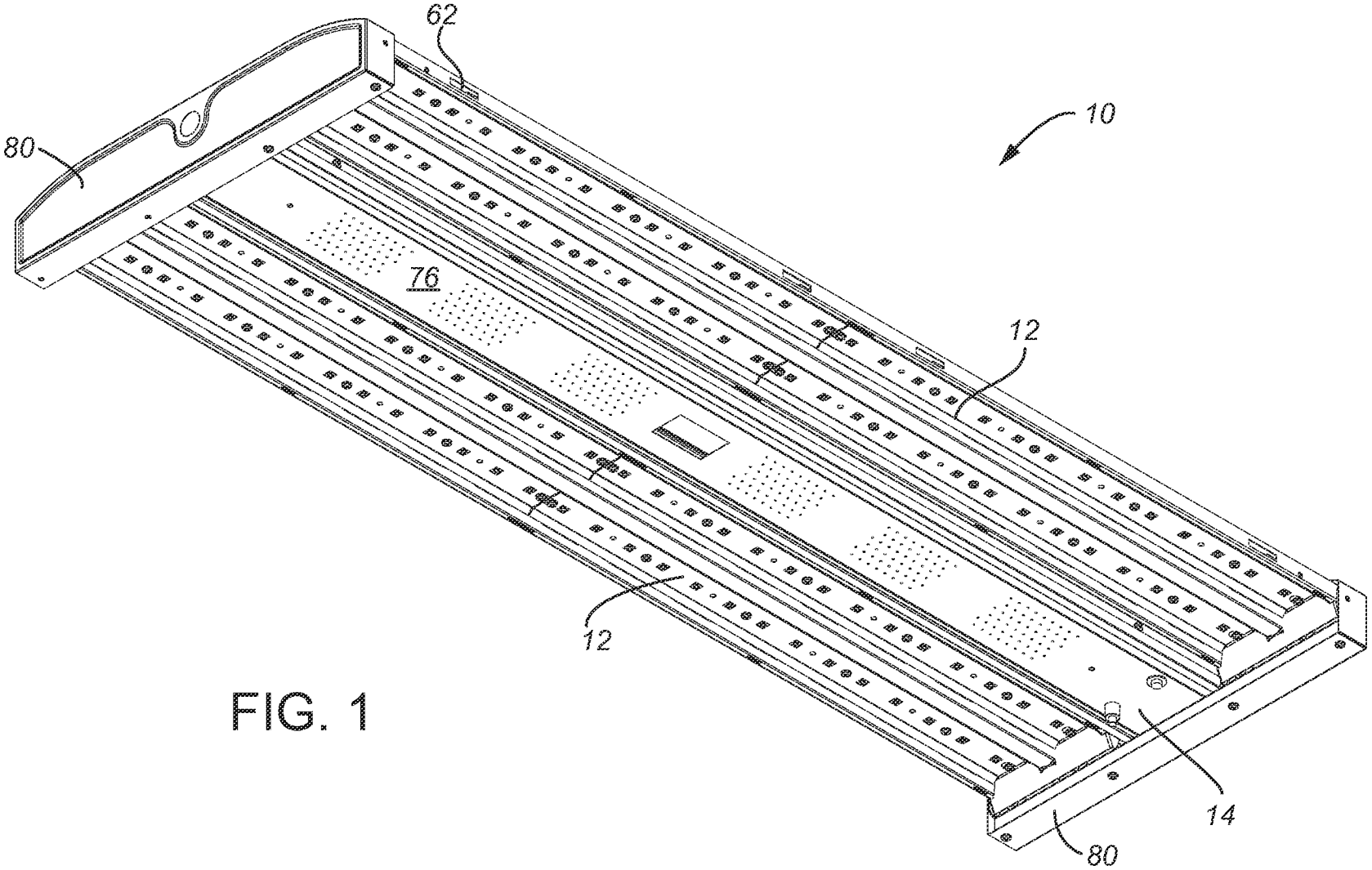
FIG. 1 is a bottom perspective view of one embodiment of a light fixture provided with the reflector of FIGS. 12*a* and 12*b*.
Figure 2:
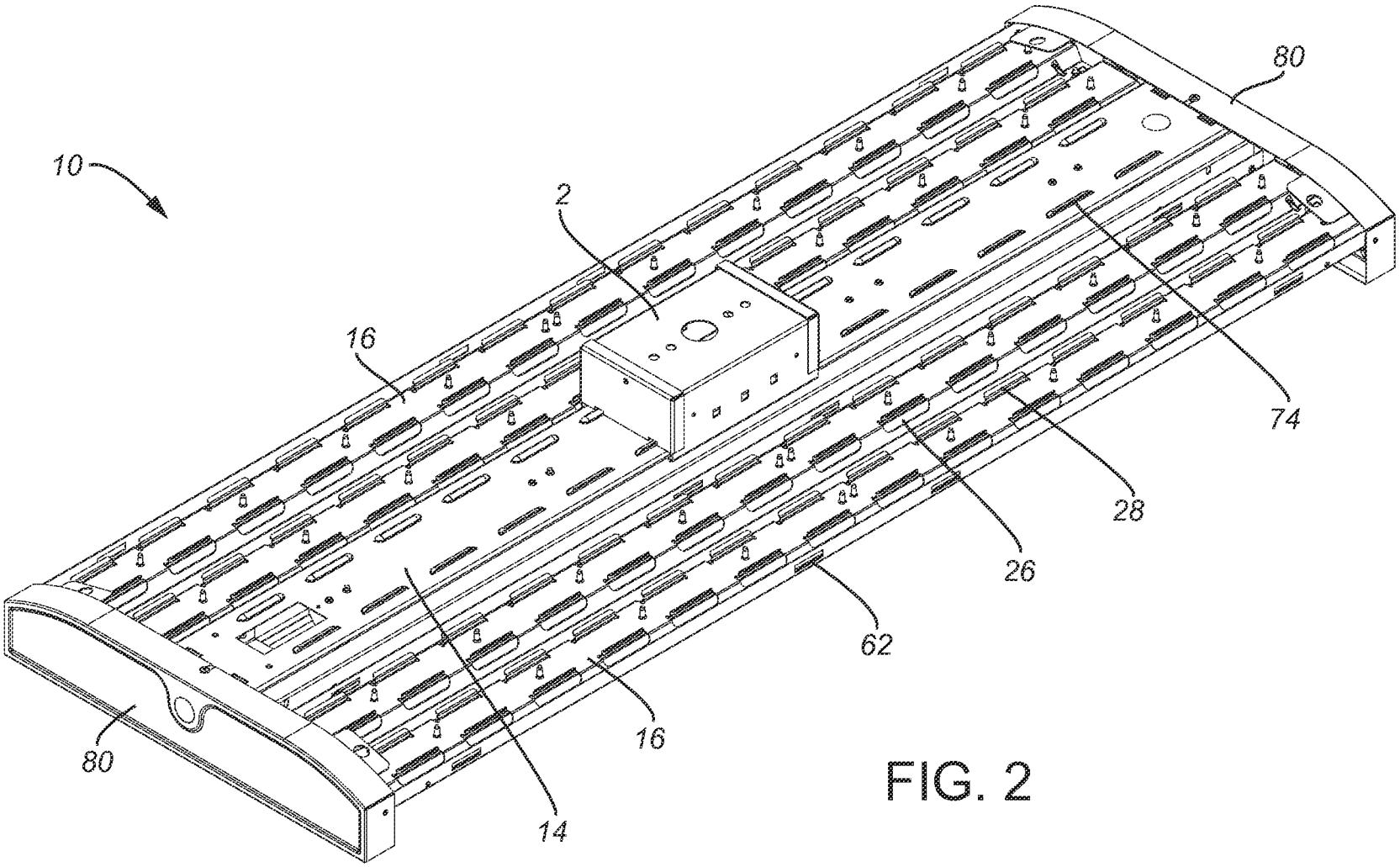
FIG. 2 is a top perspective view of the light fixture of FIG. 1.
Figure 3:
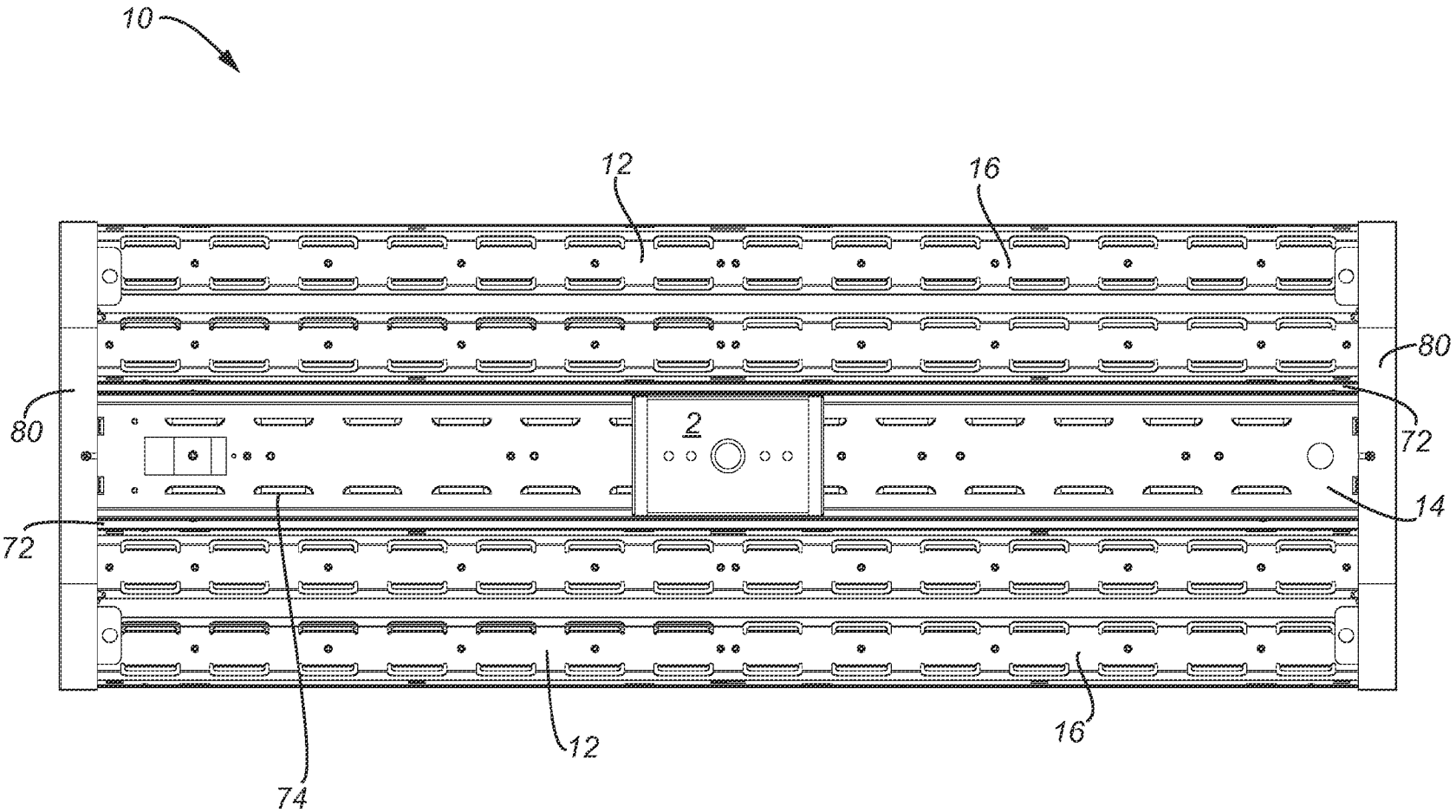
FIG. 3 is a top plan view of the light fixture of FIG. 1.
Figure 4:
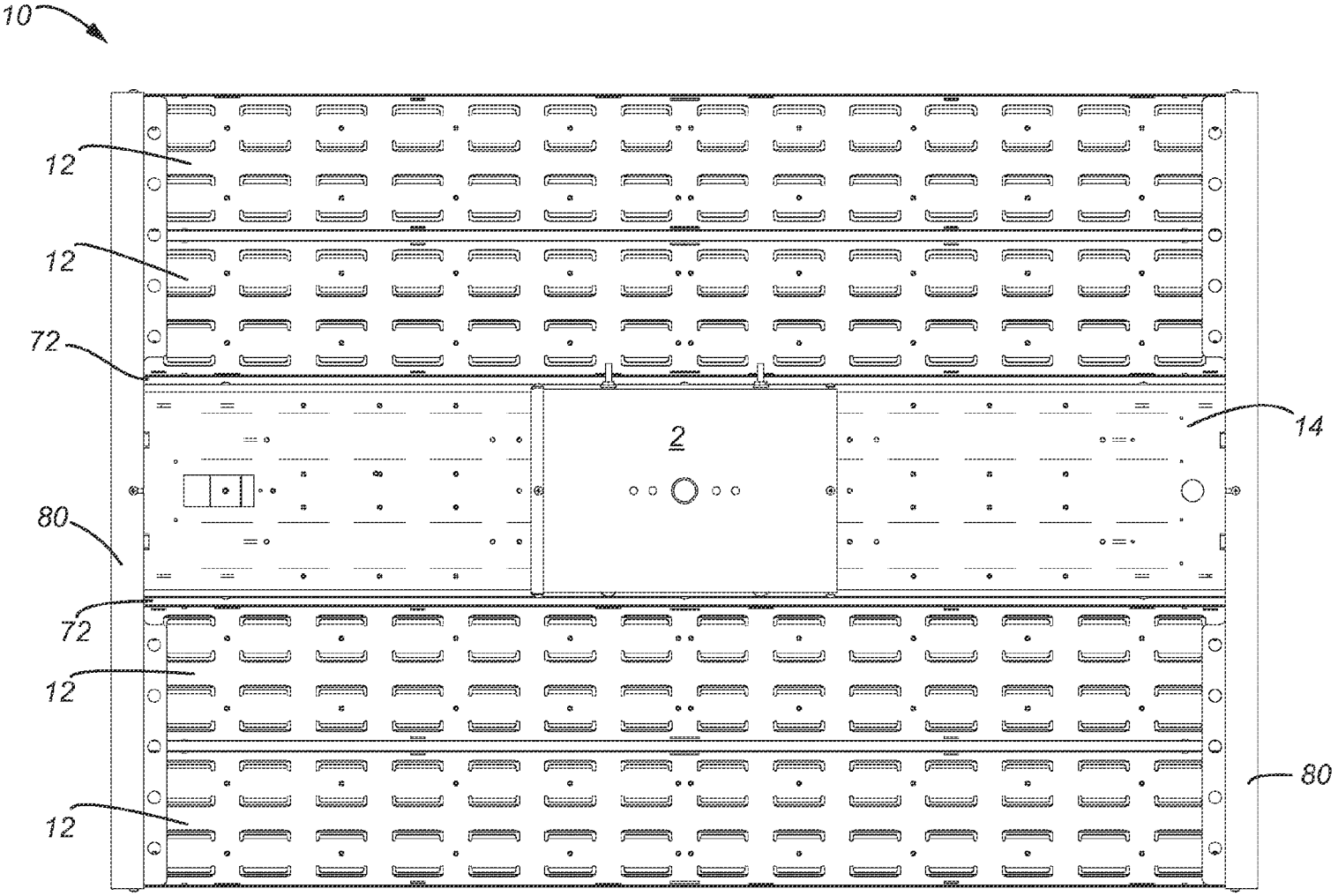
FIG. 4 is a top plan view of an alternative embodiment of a light fixture.
Figure 23:
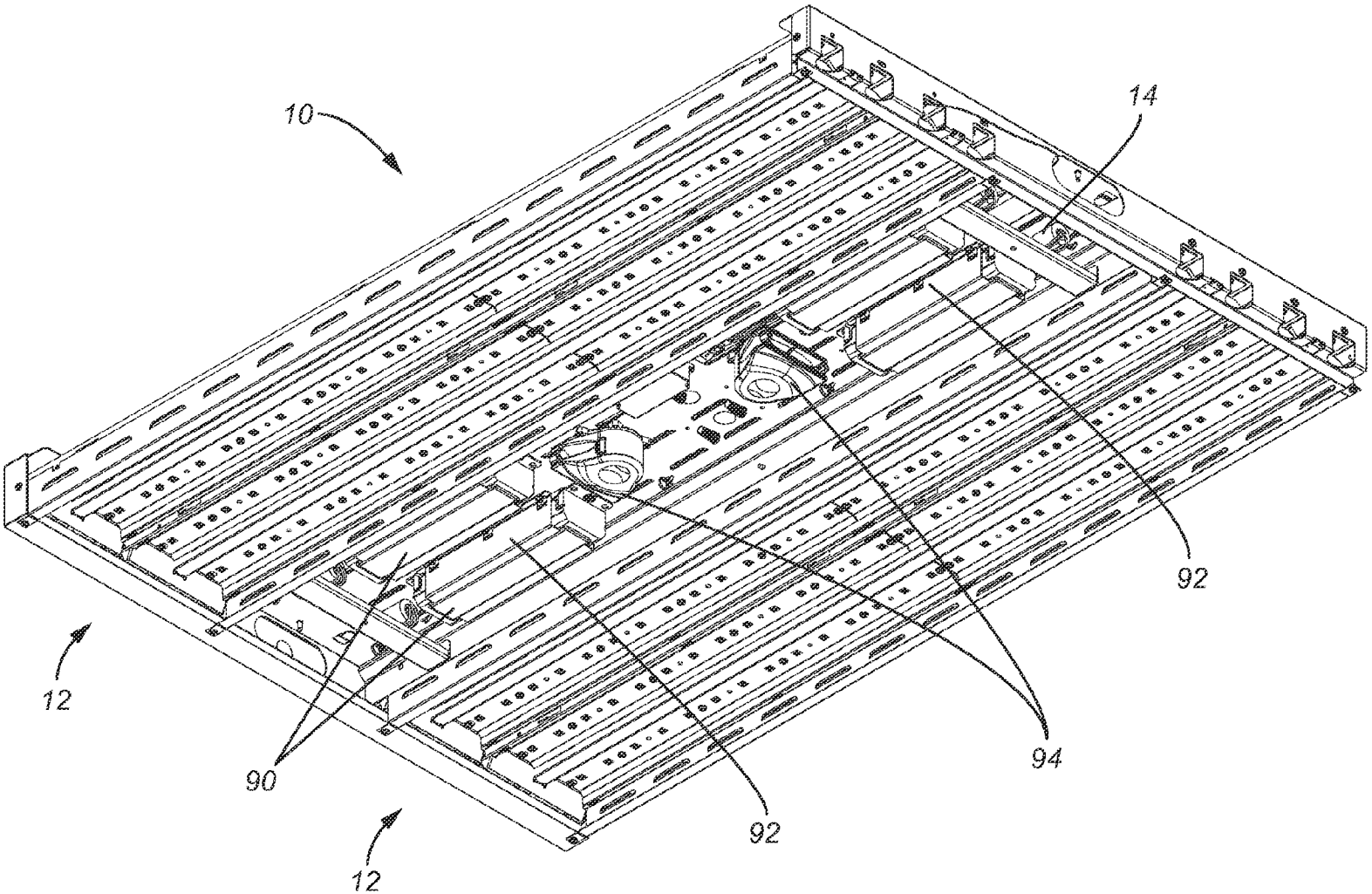
FIG. 23 is a bottom perspective view of an embodiment of a light fixture with the cover removed from the electronic housing.

In the illustrated embodiment of FIGS. 1-3, the light fixture 10 is formed by two optical chambers 12 and an electronic housing 14 interposed between the optical chambers 12 for housing the electrical components 90 that drive the fixture (e.g., driver, battery pack(s), etc., shown in FIG. 23). However, any number of optical chambers could be assembled to form the fixture 10. By way only of example, multiple optical chambers 12 may be provided on each side of the electronic housing 14 and connected in series or otherwise, as shown in FIG. 4.

Figure 7:
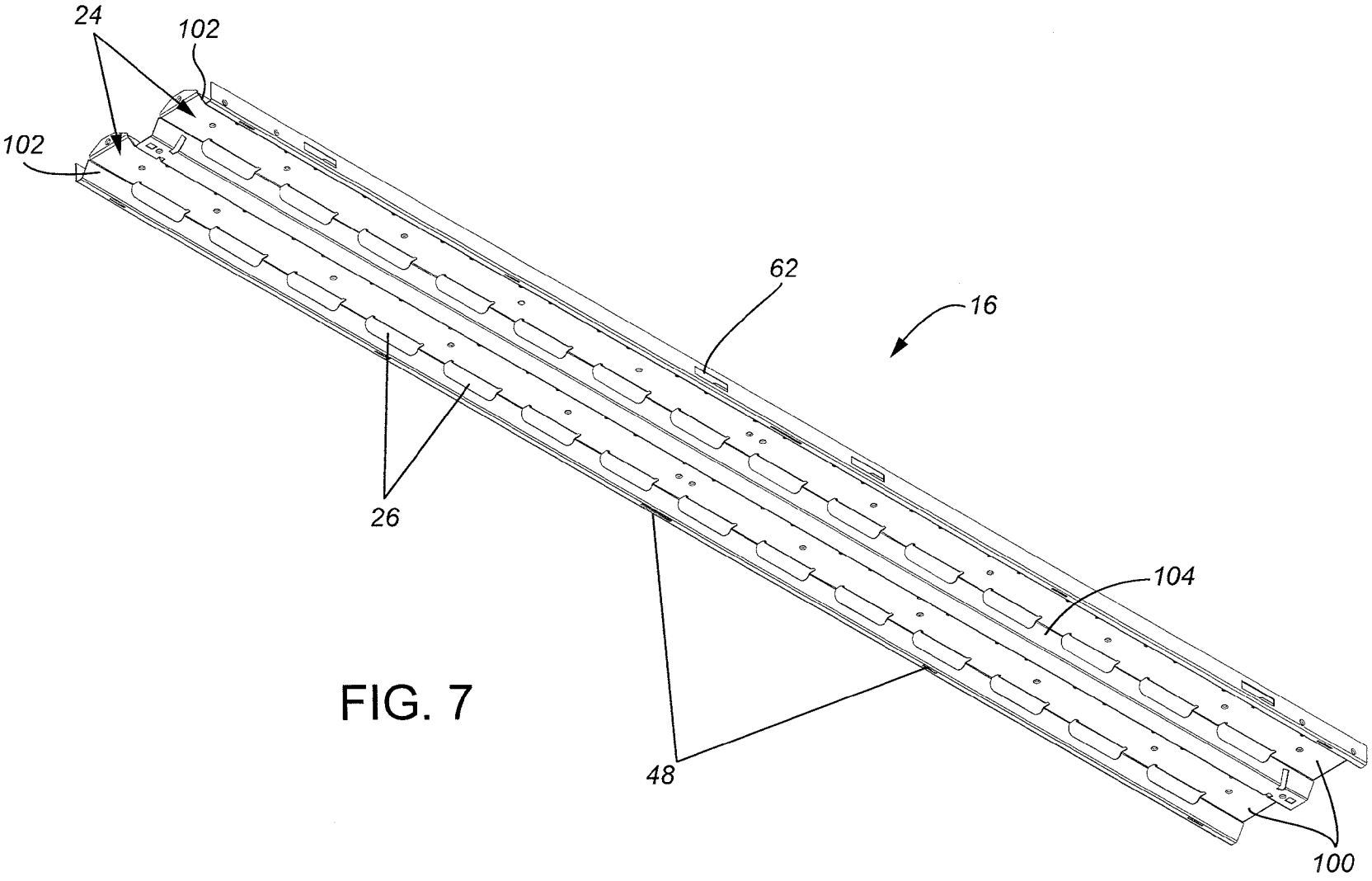
FIG. 7 is a bottom perspective view of an embodiment of a heat sink.
Figure 8:
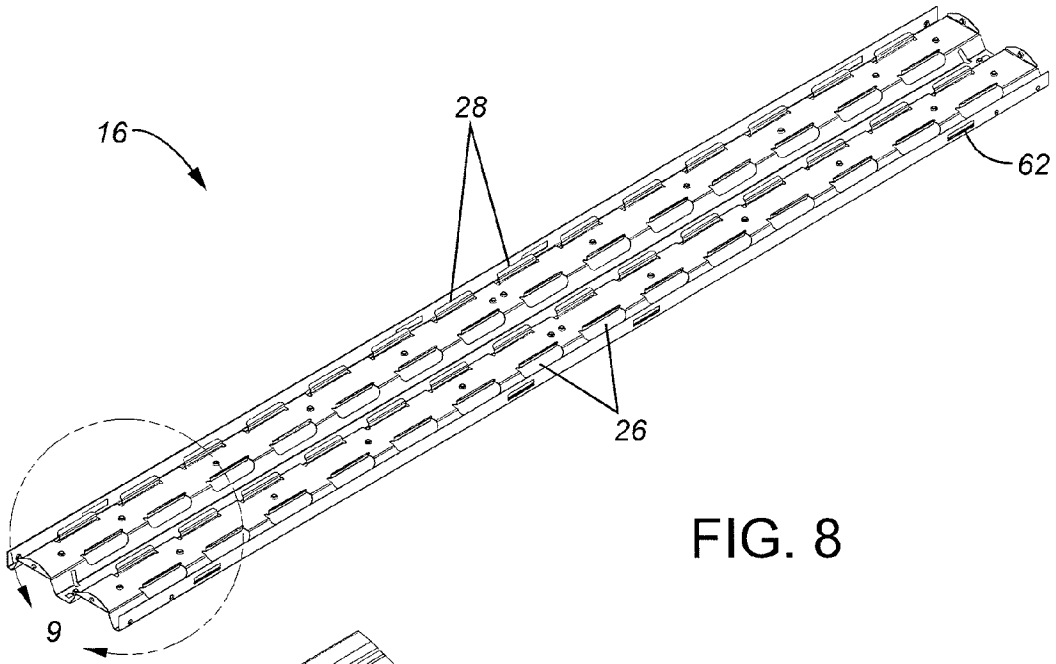
FIG. 8 is a top perspective view of the heat sink of FIG. 7.
Figure 9:
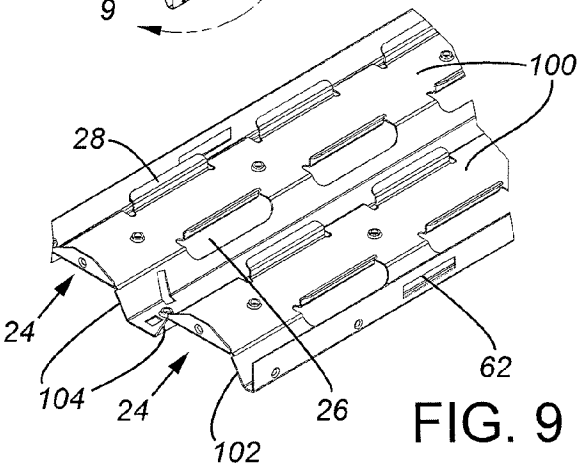
FIG. 9 is an enlarged view taken at inset circle 9 of FIG. 8.

Each optical chamber 12 includes a heat sink 16, LEDs 18 mounted on the heat sink 16, and a reflector 20, 22. An embodiment of the heat sink 16 is shown in isolation in FIGS. 7-9. The heat sink 16 may be formed from any thermally conductive material, such as metal, including steel, aluminum, etc.

The heat sink 16 within the optical chamber 12 is shown having two troughs 24 but it may have any number of troughs, including a single trough. Each trough 24 is defined by a planar portion 100 with an outer side arm 102 and an inner side arm 104 extending downwardly at an angle from the planar portion 100. Top vents 26 are provided along the top of the heat sink 16. In some embodiments, the top vents 26 are stamped from a metal sheet that is subsequently formed into the heat sink 16. The metal stamped from the metal sheet is not completely severed. Rather, it remains connected to the sheet and is bent to create a fin 28 that extends upwardly from and angles inwardly over each top vent 26. These fins 28 enhance heat dissipation from the fixture 10, as discussed in more detail below.

Figure 10:
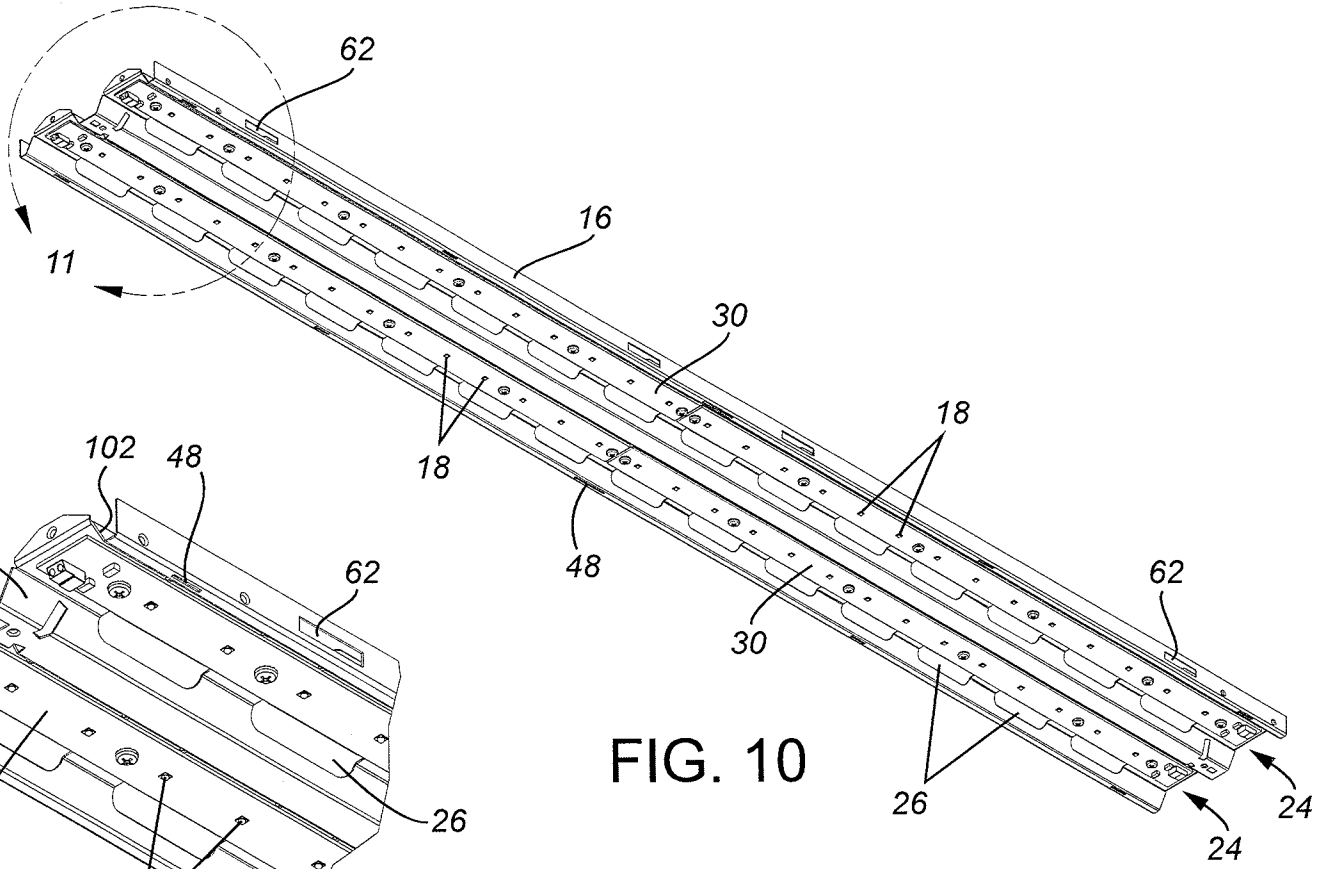
FIG. 10 is a bottom perspective view of printed circuit boards with LEDs mounted to the heat sink of FIG. 7.
Figure 11:
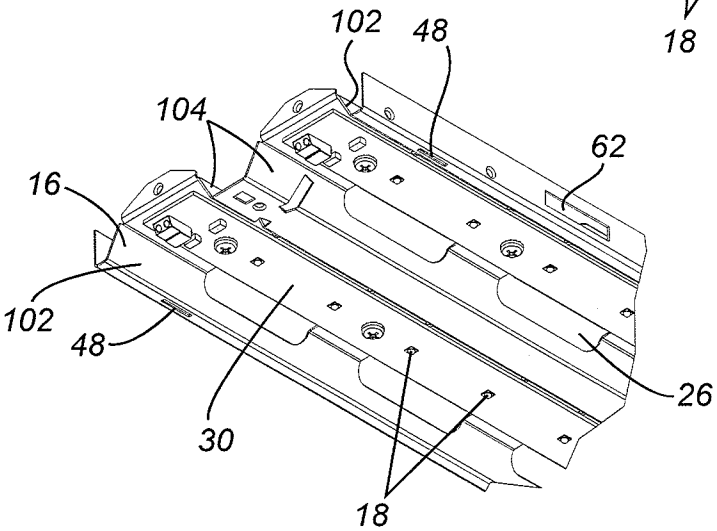
FIG. 11 is an enlarged view taken at inset circle 11 of FIG. 10.

LEDs 18 (mounted on a PCB 30) are mounted within the troughs 24 of the heat sink 16, as shown in FIGS. 10 and 11. A reflector 20, 22 is then positioned over the LEDs. The reflector 20, 22 includes apertures 32 such that, when the reflector 20, 22 is positioned over the LEDs 18, each LED 18 is positioned within an aperture 32 in the reflector 20, 22 so as to be able to emit light from the optical chamber 12. Thus, the PCB 30 is sandwiched between, and protected by, the heat sink 16 and the reflector 20, 22. Because of the protection afforded the PCB 30, the PCB 30 can be, but need not be, a metal-core board but rather less expensive boards may be used.

Figure 5:
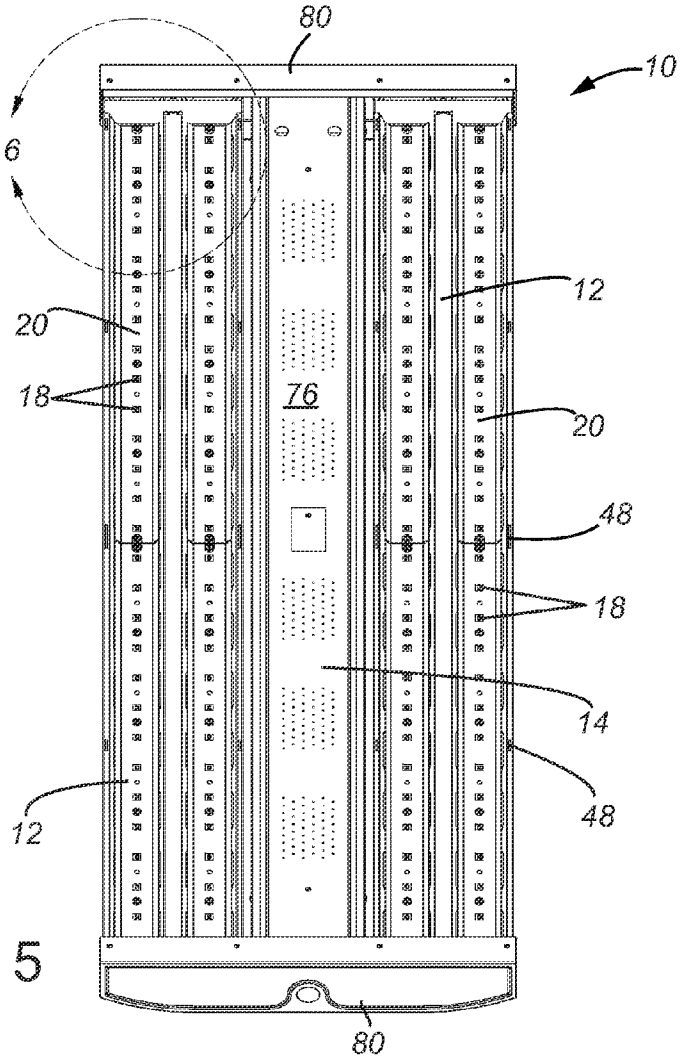
FIG. 5 is another bottom perspective view of the light fixture of FIG. 1.
Figure 6:
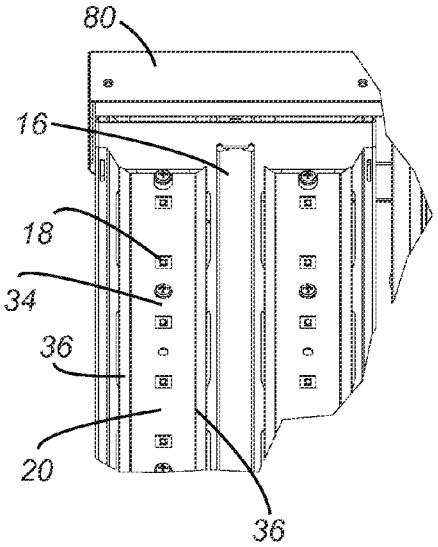
FIG. 6 is an enlarged view taken at inset circle 6 of FIG. 5.
Figure 12A:
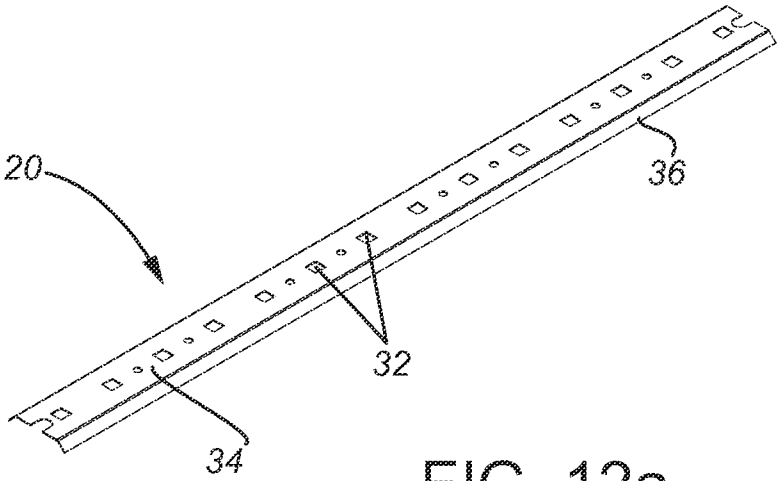
FIG. 12*a* is a top perspective view of one embodiment of a reflector for use in a light fixture.
Figure 12B:
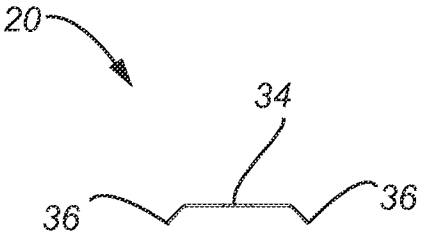
FIG. 12*b* is an end view of the reflector of FIG. 12*a*.

Different reflector geometries are contemplated and are certainly not intended to be limited to the precise geometries depicted in the figures. A first embodiment of a reflector 20 is shown in isolation in FIGS. 12*a* and 12*b* and incorporated into a light fixture 10 in FIGS. 1, 5, and 6. Reflector 20 includes a substantially flat top portion 34 that seats over the PCB 30 and angled side walls 36 that extend downwardly from each side of the top portion 34.

Figure 13A:
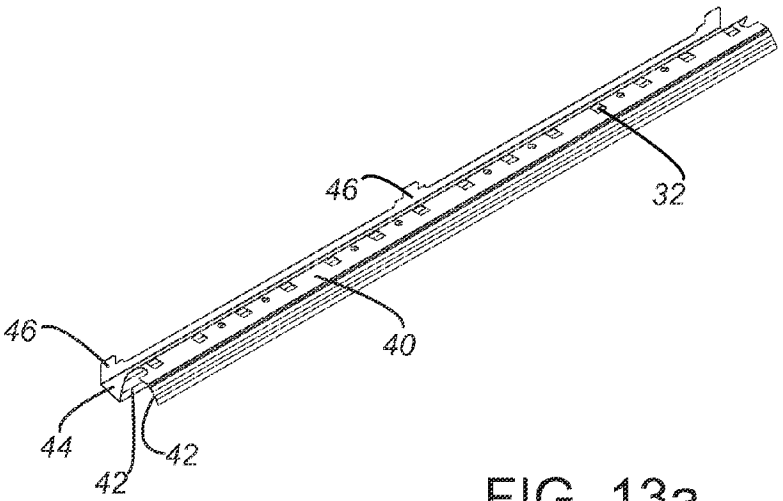
FIG. 13*a* is a top perspective view of another embodiment of a reflector for use in a light fixture.
Figure 13B:
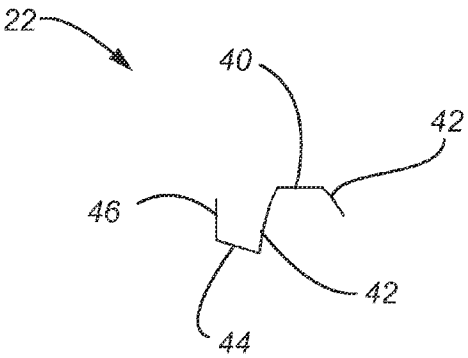
FIG. 13*b* is an end view of the reflector of FIG. 13*a*.
Figure 17:
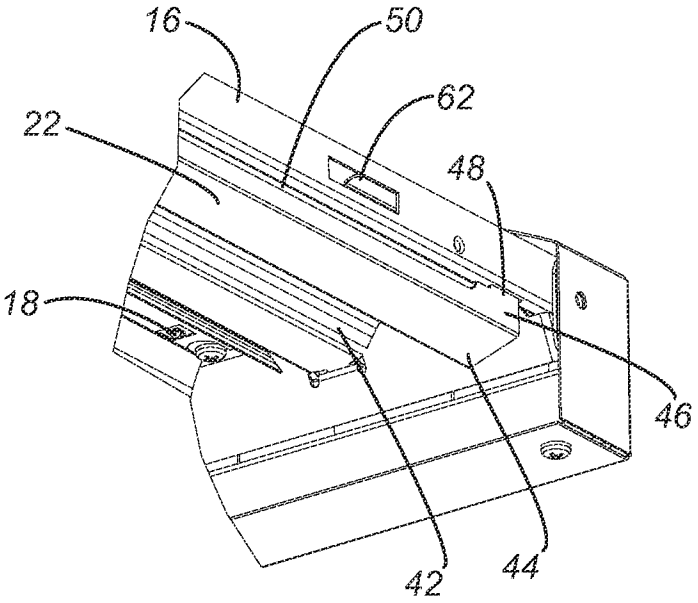
FIG. 17 is yet another enlarged view of the light fixture of FIG. 14.
Figure 18:
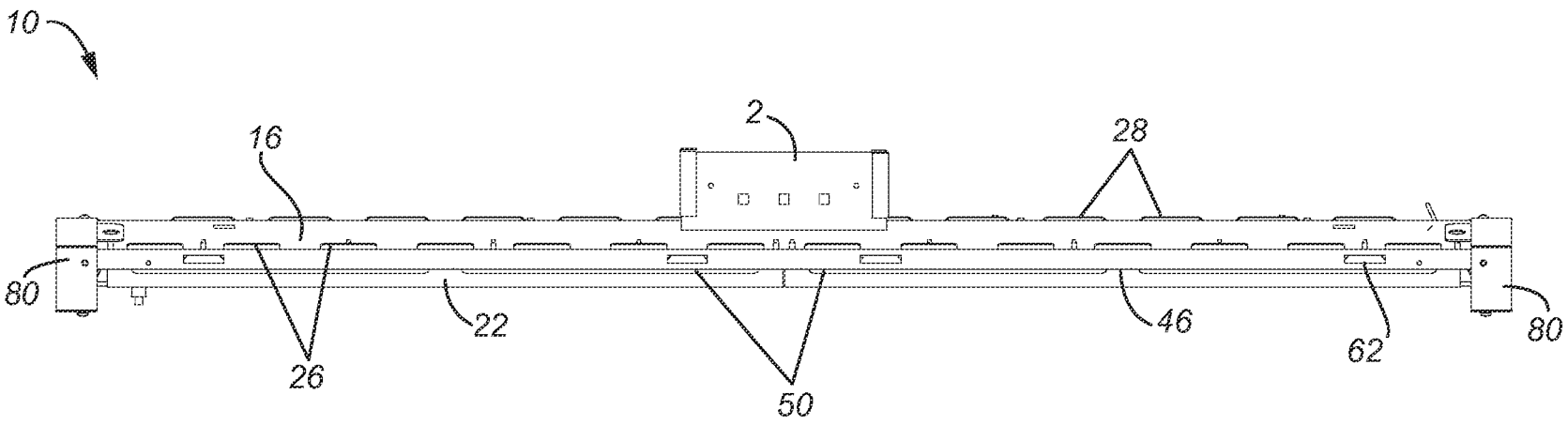
FIG. 18 is a side elevation view of the light fixture of FIG. 14.

A second embodiment of a reflector 22 is shown in isolation in FIGS. 13*a* and 13*b* and incorporated into a light fixture 10 in FIGS. 14-17. Reflector 22 includes a substantially flat top portion 40 that seats over the PCB 30, angled side walls 42 that extend downwardly from each side of the top portion 40 (although not necessarily at the same angle from each side of the top portion 40), and a ledge 44 that extends from one of the angled side walls 42. The ledge 44 includes upwardly extending arms 46 spaced along the length of the ledge 44. When the reflector 22 is properly positioned on the heat sink 16 over the LEDs 18, the upwardly extending arms 46 engage slots 48 located in the heat sink 16. See FIG. 17. A gap 50 is formed between the heat sink 16 and the reflector 22 between adjacent upwardly extending arms 46, as seen in FIGS. 17 and 18. Multiple gaps 50 may be formed in this way along the length of the optical chamber 12.

The reflectors 20, 22 may be formed of any suitable thermally conductive material, including metal such as painted steel or aluminum. In use, heat generated by the LEDs 18 is conducted both to the heat sink 16 behind the PCB 30 and the reflector 20, 22 positioned over the PCB 30. Thus, the reflector 20, 22 effectively acts as a heat sink as well.

Figure 14:
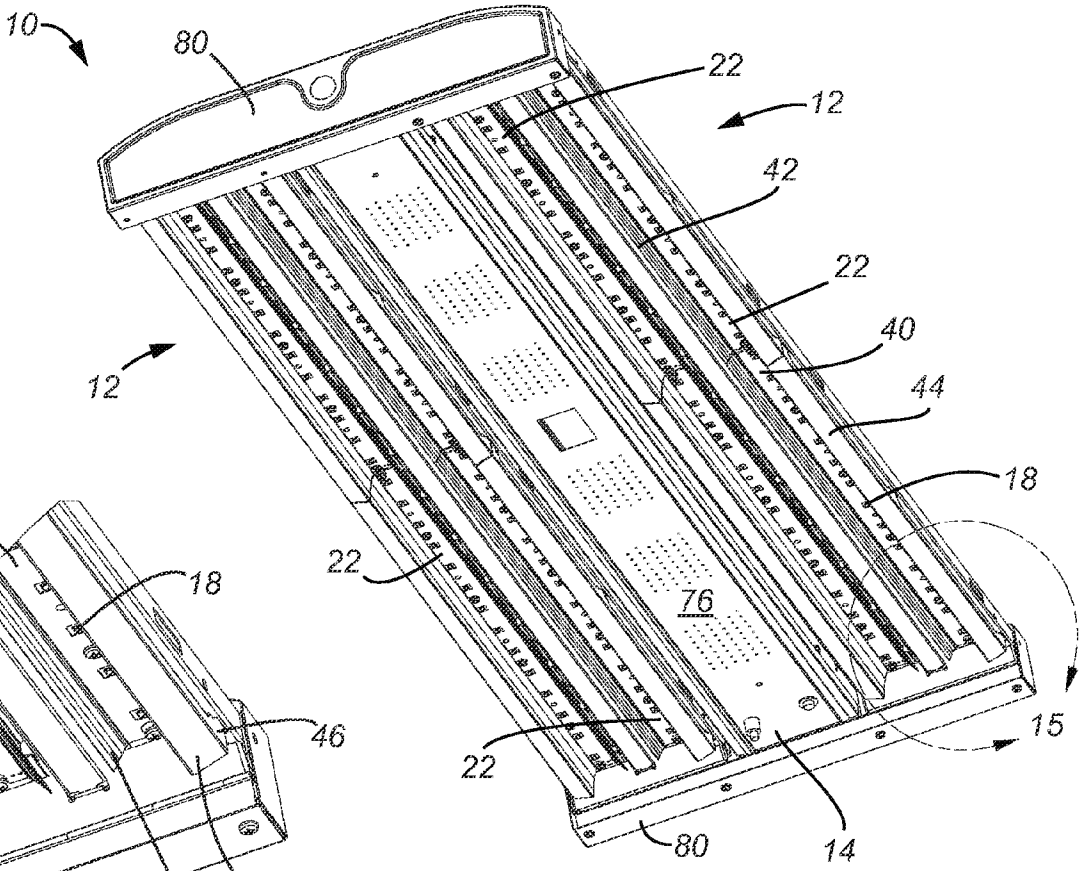
FIG. 14 is a bottom perspective view of an embodiment of a light fixture provided with the reflector of FIGS. 13*a* and 13*b*.
Figure 15:
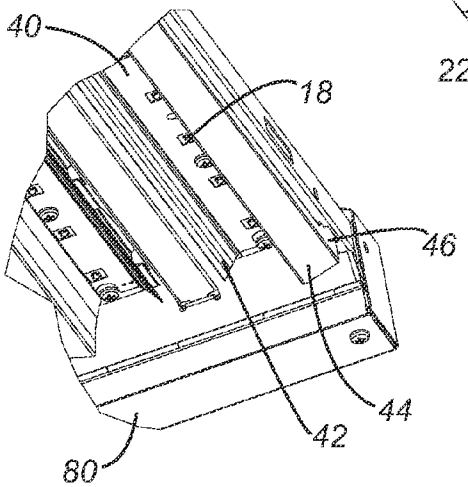
FIG. 15 is an enlarged view taken at inset circle 15 of FIG. 14.
Figure 16:
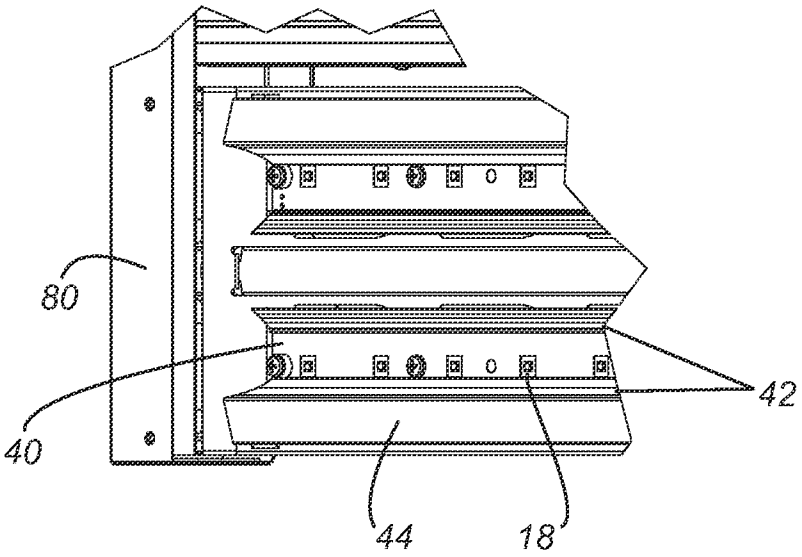
FIG. 16 is another enlarged view of the light fixture of FIG. 14.
Figure 20:
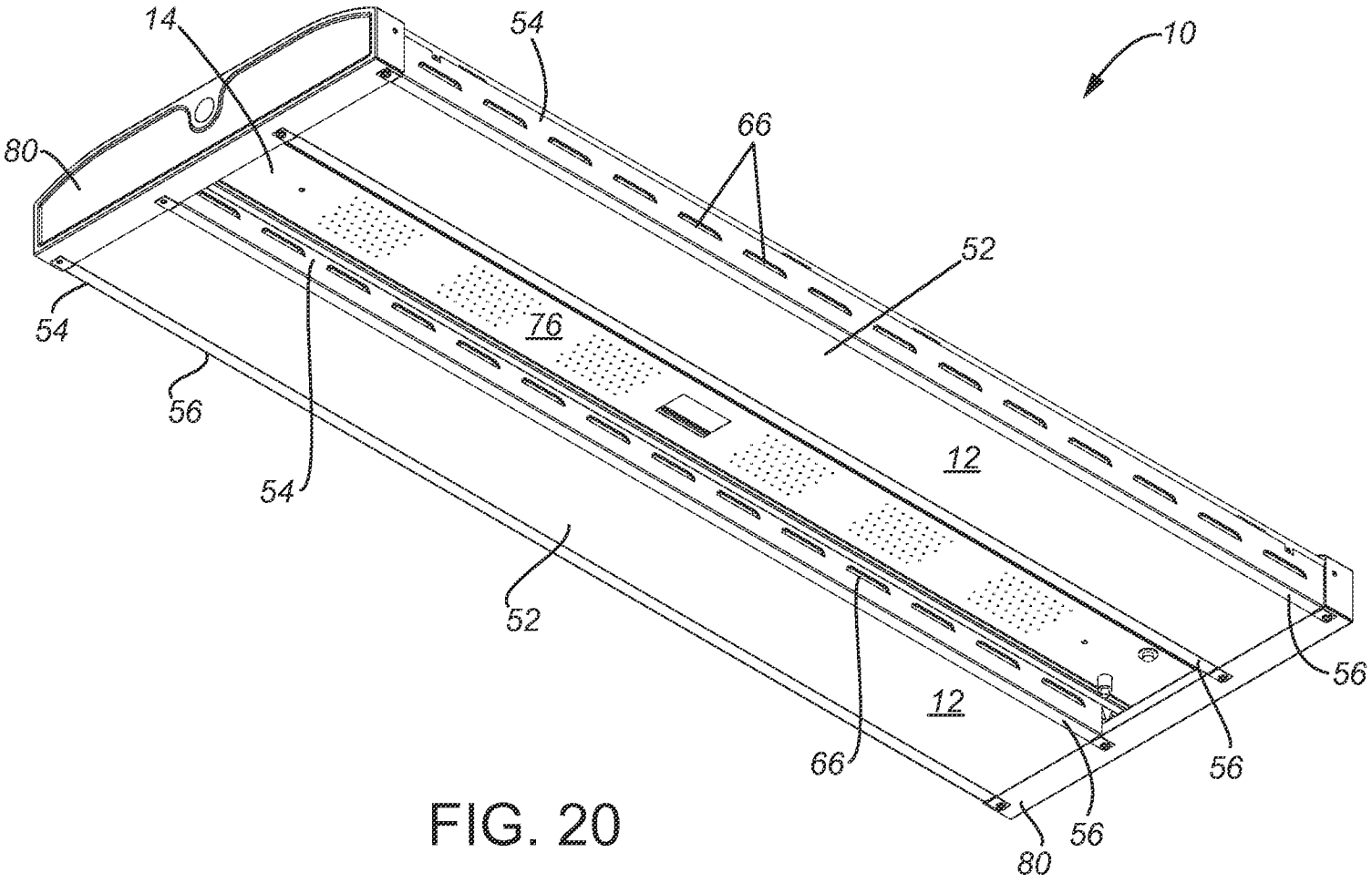
FIG. 20 is a bottom perspective view of yet another embodiment of a light fixture.

The light fixture 10 may be used as an open fixture (i.e., the optical chambers 12 remain open and air is free to enter each chamber 12 from below, as shown in FIGS. 1 and 14) or a lens 52 may be positioned over each optical chamber 12 to enclose each chamber 12, such as shown in the embodiment of FIG. 20. In the open fixture situation, cooler air enters the optical chambers 12 from below the fixture 10 and exits the fixture 10 through the top vents 26 in the heat sink 16. The air circulates over the angled side walls 36, 42 of the reflectors 20, 22, carrying heat from the reflectors 20, 22 during the process. In this way, the reflectors 20, 22 operate as heat sink fins. Heat is also conducted to the air from the heat sink 16. The angled fins 28 extending over the top vents 26 provide additional surface area for contact with the air and thus facilitate additional heat transfer from the heat sink 16.

Thus, heat dissipation from the fixture 10 results both from conduction of heat from the LEDs 18 via the reflectors 20, 22 and the heat sink 16 as well as conduction and convection of heat from the reflectors 20, 22 and the heat sink 16 to the air circulating through and around the reflectors 20, 22 and heat sink 16. Such air consequently heats up and rises, thereby carrying heat away from the fixture 10 through the top vents 26 via convection.

Figure 21:
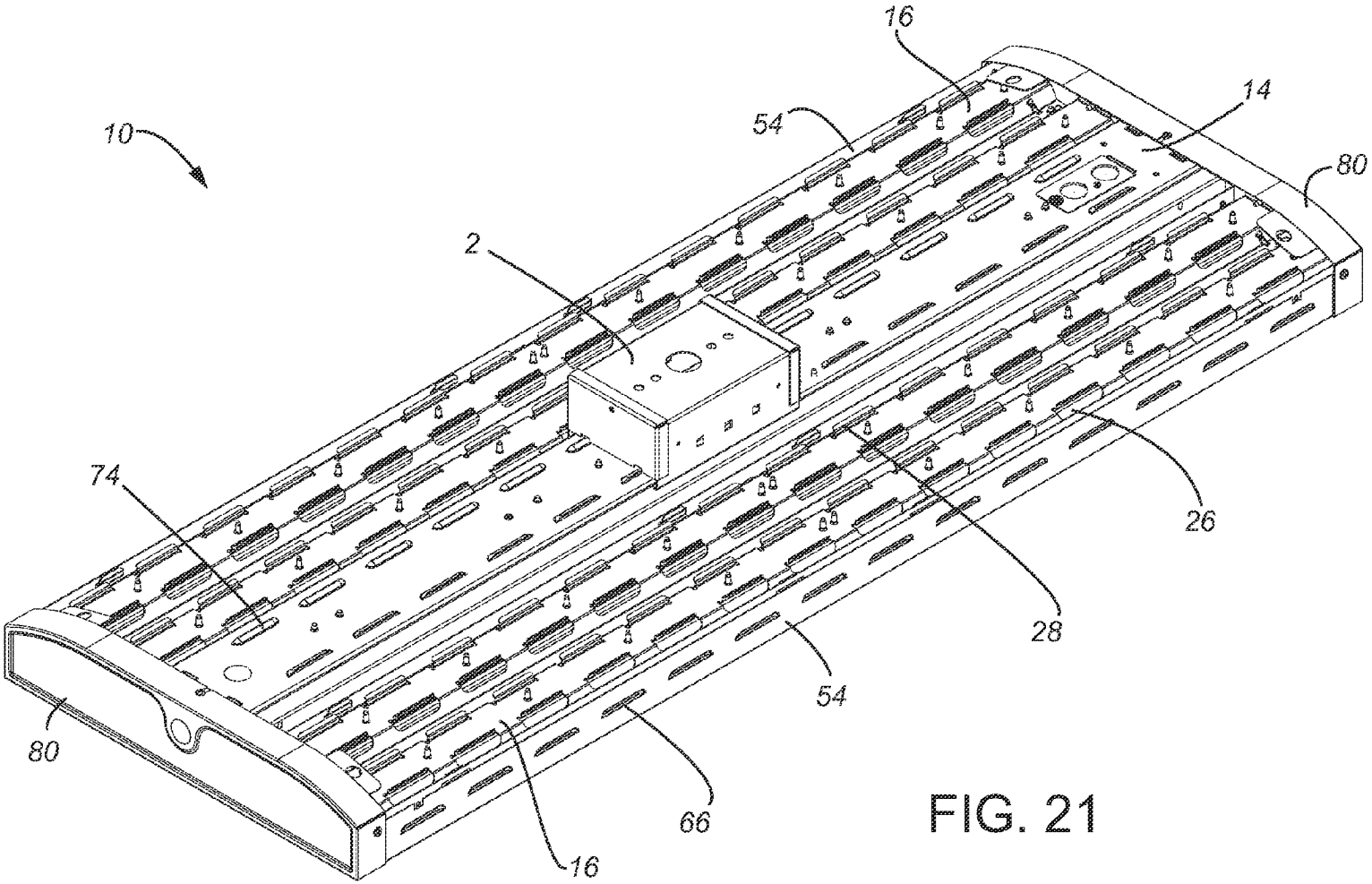
FIG. 21 is a top perspective view of the light fixture of FIG. 20.

It is also possible to enclose the optical chambers 12, such as with a lens 52. See FIG. 20. However, then alternative paths must be provided to permit air ingress into the optical chambers 12 to facilitate cooling. FIGS. 19*a*-19*c* show in isolation an embodiment of a side door frame 54 that is used (i) to help retain a lens 52 over an optical chamber 12 and (ii) for thermal management purposes. A side door frame 54 is positioned on the sides of the heat sink 16, as shown in FIGS. 20 and 21. The side door frame includes a ledge 56 (see FIG. 19*c*) upon which the lens 52 rests when the side door frame 54 is so positioned. In this way, the side door frame 54 supports and helps retain the lens 52 on the fixture 10.

In the illustrated embodiment, the side door frames 54 are retained on the heat sink via tabs 60 on the side door frames 54 engaging slots 62 in the heat sink 16. However, the side door frame 54 may be mounted on the heat sink 16 using a variety of other mechanical retention methods.

Vents 66 may be located along the length of each side door frame 54. Such vents 66 permit air to enter each optical chamber 12, which is closed by virtue of the lens 52. If reflector 20 is used, the air is free to enter the chamber 12. If reflector 22 is used, the vents 66 align with the gaps 50 formed between the heat sink 16 and the reflector 22 so that air can easily flow into the chamber 12 for convective cooling, as described above. The vents 66 on the side door frame 54 may be angled or punched inwardly to prevent light from escaping through such vents 66, thus preventing the undesirable glare such light would cause to inhabitants below.

Figure 22:
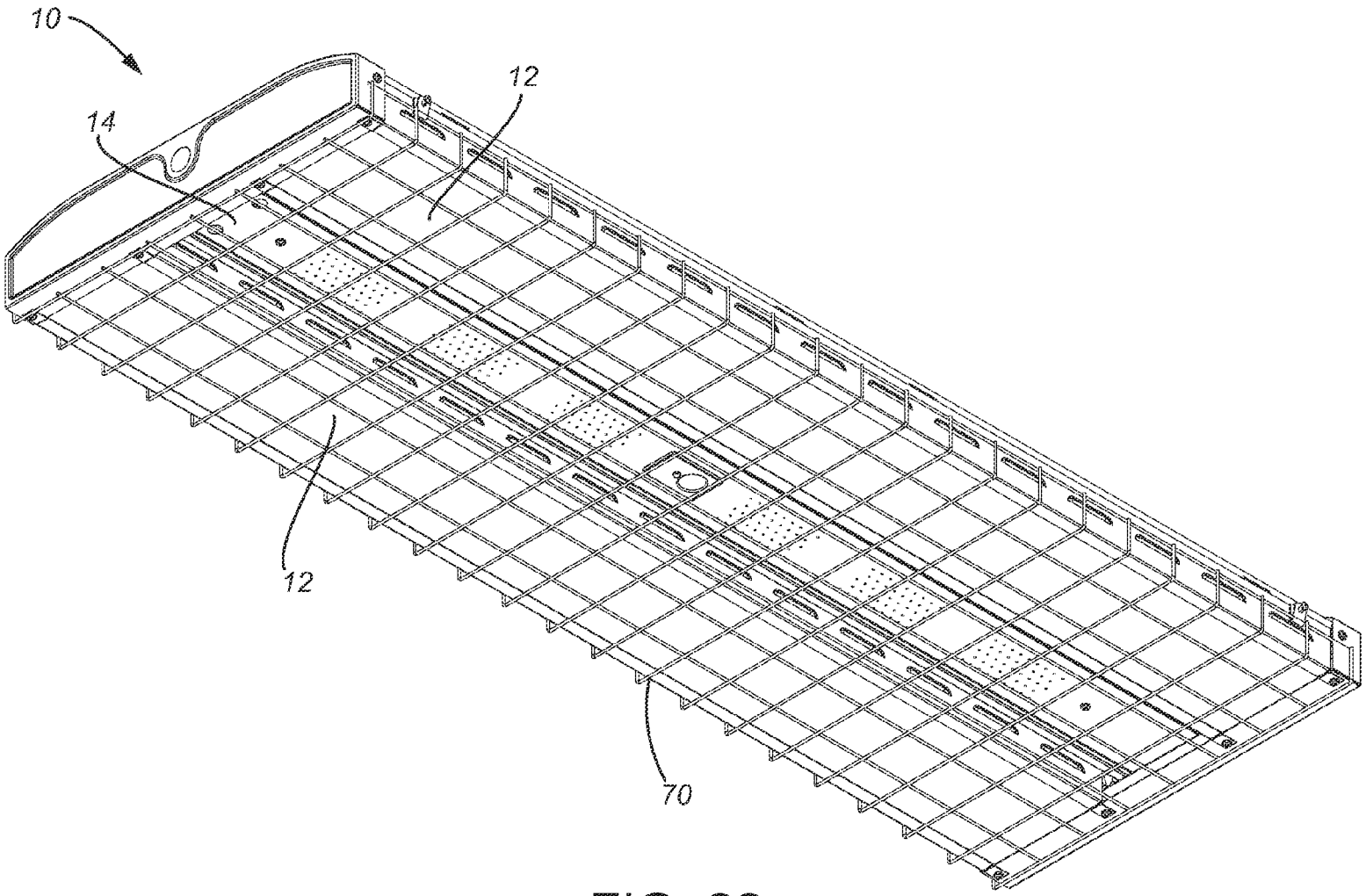
FIG. 22 is a bottom perspective view of still another embodiment of a light fixture.

End caps 80 may be provided at the ends of the optical chambers 12 and the electronic housing 14 to hold the components together. Moreover, a wire guard 70 (see FIG. 22) may be positioned on the fixture 10 to protect the fixture 10, although inclusion of a wire guard 70 is entirely optional.

In some embodiments, the electronic housing 14 is interposed between each optical chamber 12. While not necessary, it may be desirable that each optical chamber 12 be spaced a distance from the electronic housing 14 to prevent creation of a thermal path between the optical chambers 12 and the electronic housing 14 and thereby thermally protect the electronics contained within the electronic housing 14. Air gaps 72 formed between the electronic housing 14 and the optical chambers 12 are seen in FIG. 3. The electronic housing 14 may also contain vents 74 for convective cooling purposes. In some embodiments (see FIG. 23), heat spreaders 92 are provided on some or all of the electronic components 90 housed in the electronic housing 14. Moreover, one or more active cooling systems 94, such as a fan or synthetic jet actuator (such as SynJet® cooling technology, available from Nuventix), may be provided within the electronic housing 14 and used to blow air across the heat spreaders 92 to help dissipate heat from the electronic components 90 and from the electronic housing 14. A cover 76 encloses the electronic housing 14 and is easily removable from below to access the electronics 90 without having to remove the lenses 52 (if lenses are provided).

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

I claim:

1. A light fixture comprising:

(a) an electronic housing; and (b) a first and a second optical chamber, each comprising:

(i) a heat sink comprising:

at least one planar portion;

an outer side arm and an inner side arm, each extending downwardly at an angle from the at least one planar portion so as to define at least one trough having a trough opening, wherein the outer side arm terminates in an outer heat sink edge; and a plurality of vents extending through the at least one heat sink, wherein at least one fin integrally-formed with the heat sink extends upwardly from the heat sink and angles at least partially over at least one of the plurality of vents;

(ii) at least one printed circuit board having a surface on which at least one light emitting diode is mounted, wherein the at least one printed circuit board is mounted on the at least one planar portion of the heat sink within the at least one trough; and (iii) at least one reflector comprising at least one aperture, wherein the at least one reflector is positioned over at least a portion of the surface of the at least one printed circuit board so as to cover the portion of the surface and so that the at least one light emitting diode is positioned within the at least one aperture of the at least one reflector, wherein the first and second optical chambers are positioned (A) exterior to, and on opposing sides of, the electronic housing such that the electronic housing is interposed between the first and second optical chambers and (B) a distance from the electronic housing such that an air gap is formed between the electronic housing and each of the first and second optical chambers.

2. The light fixture of claim 1, wherein the electronic housing comprises a plurality of vents through which heat may dissipate from the electronic housing.

3. The light fixture of claim 1, wherein the at least one reflector comprises a substantially flat top portion that is positioned over at least a portion of the surface of the at least one printed circuit board.

4. The light fixture of claim 3, wherein the top portion of the at least one reflector comprises opposing sides and wherein the at least one reflector further comprises a side wall that extends downwardly at an angle from each opposing side of the top portion.

5. The light fixture of claim 4, wherein the at least one reflector further comprises a ledge that extends outwardly from one of the side walls of the at least one reflector, wherein the ledge is positioned below and a distance from the outer heat sink edge of the heat sink so as to form an air gap between the ledge and the outer heat sink edge of the heat sink.

6. The light fixture of claim 1, wherein the light fixture is adapted to permit air to enter the first and second optical chambers through the trough opening of each first and second optical chamber and exit the light fixture through the plurality of vents in the heat sink.

7. The light fixture of claim 1, wherein the first and second optical chambers each further comprises a lens extending across at least a portion of the trough opening so as to at least partially enclose each of the first and second optical chambers.

8. The light fixture of claim 7, wherein each of the first and second optical chambers further comprises a side door frame mounted on the outer heat sink edge of each of the first and second optical chambers.

9. The light fixture of claim 8, wherein the side door frame comprises a ledge upon which the lens of each of the first and second optical chambers rests to support the lens on each of the first and second optical chambers.

10. The light fixture of claim 8, wherein the side door frame comprises a plurality of vents extending along a length of the side door frame so as to permit air to enter each of the first and second optical chambers through the plurality of vents on the side door frame.

11. A light fixture comprising:

(a) an electronic housing; and (b) a first and a second optical chamber, each comprising:

(i) a heat sink comprising:

at least one planar portion;

an outer side arm and an inner side arm, each extending downwardly at an angle from the at least one planar portion so as to define at least one trough having a trough opening, wherein the outer side arm terminates in an outer heat sink edge; and a plurality of vents extending through the at least one heat sink, wherein at least one fin integrally-formed with the heat sink extends upwardly from the heat sink and angles at least partially over at least one of the plurality of vents;

(ii) at least one printed circuit board having a surface on which at least one light emitting diode is mounted, wherein the at least one printed circuit board is mounted on the at least one planar portion of the heat sink within the at least one trough;

(iii) at least one reflector comprising a substantially flat top portion having opposing sides, a plurality of apertures defined in the top portion, and a side wall extending downwardly at an angle from each opposing side of the top portion, wherein the top portion of the reflector is positioned over at least a portion of the surface of the at least one printed circuit board so as to cover the portion of the surface and so that the at least one light emitting diode is positioned within the at least one aperture of the at least one reflector; and (iv) a lens extending across at least a portion of the trough opening so as to at least partially enclose each of the first and second optical chambers, wherein the first and second optical chambers are positioned (A) exterior to, and on opposing sides of, the electronic housing such that the electronic housing is interposed between the first and second optical chambers and (B) a distance from the electronic housing such that an air gap is formed between the electronic housing and each of the first and second optical chambers.

12. The light fixture of claim 11, wherein the at least one reflector further comprises a ledge that extends outwardly from one of the side walls of the at least one reflector, wherein the ledge is positioned below and a distance from the outer heat sink edge of the heat sink so as to form an air gap between the ledge and the outer heat sink edge of the heat sink.

13. The light fixture of claim 11, each of the first and second optical chambers further comprises a side door frame mounted on the outer heat sink edge of each of the first and second optical chambers.

14. The light fixture of claim 13, wherein the side door frame comprises a ledge upon which the lens of each of the first and second optical chambers rests to support the lens on each of the first and second optical chambers.

15. The light fixture of claim 13, wherein the side door frame comprises a plurality of vents extending along a length of the side door frame so as to permit air to enter each of the first and second optical chambers through the plurality of vents on the side door frame.

* * * * *